US005746036A

United States Patent [19]

Angelette

[11] Patent Number: 5,746,036

[45] Date of Patent: May 5, 1998

[54] RAILROAD CROSSING SIGNAL FOUNDATION AND SPIDER AND METHOD OF PRODUCING THE SAME

[76] Inventor: A. M. Angelette, 4160 Ewing Rd., Austell, Ga. 30001

[21] Appl. No.: 783,814

[22] Filed: Jan. 13, 1997

Related U.S. Application Data

[63] Continuation-in-part of Ser. No. 501,707, Jul. 10, 1995, abandoned.

[51] Int. Cl.[6] ..... E02D 27/42

[52] U.S. Cl. ..... 52/295; 52/294; 249/48; 249/163; 405/252

[58] Field of Search ..... 52/294, 295, 297, 52/298, 741.15, 742.14, 745.17, 745.18; 249/43, 48, 163, 217; 264/333; 405/252

[56] References Cited

U.S. PATENT DOCUMENTS

| | | | |
|---|---|---|---|
| 1,529,895 | 3/1925 | La Chance et al. | 52/292 X |
| 1,847,814 | 3/1932 | Byrne, Jr. | 405/252 |
| 2,374,624 | 4/1945 | Schwendt | 52/298 X |
| 3,782,061 | 1/1974 | Minutoli et al. | 52/298 X |
| 4,159,099 | 6/1979 | Maguire | 249/43 X |
| 4,408,940 | 10/1983 | Fischer | 52/295 X |
| 4,592,678 | 6/1986 | McNinch, Jr. et al. | 405/284 |
| 5,231,808 | 8/1993 | Angelette | 52/294 X |
| 5,257,489 | 11/1993 | Angelette | 52/741.15 X |
| 5,423,362 | 6/1995 | Knight | 249/217 X |
| 5,533,835 | 7/1996 | Angelette | 52/296 X |

*Primary Examiner*—Wynn E. Wood
*Assistant Examiner*—Kevin D. Wilkens
*Attorney, Agent, or Firm*—Kennedy,Davis & Kennedy, P.C.

[57] ABSTRACT

A spider for a railroad crossing signal foundation has plastic lined tubular channels extending through it with conical entry sections. In assembling a foundation, upright guide rods are guided into the channels by the entry sections without dislodging the plastic liners. In producing the spider, concrete is poured into a mold about tubular plastic liners so as to form entry sections and channels and to fix the plastic liners in the concrete to line the channels.

7 Claims, 9 Drawing Sheets

RAILROAD CROSSING SIGNAL FOUNDATION AND SPIDER AND METHOD OF PRODUCING THE SAME

REFERENCE TO RELATED APPLICATION

This is a continuation-in-part of application Ser. No. 08/501.707 filed Jul. 10, 1995 now abandoned.

TECHNICAL FIELD

This invention relates generally to foundations for railroad crossing signal and traffic control devices, to spider elements of such foundations, and to methods of producing such.

BACKGROUND OF THE INVENTION

Railroad crossings have long existed where automotive roads and highways cross railroad tracks. Initially, signs were posted at railroad crossings to warn automotive vehicle drivers of oncoming trains to avoid the possibility of collisions. Today, such signs are made larger and equipped with flashing lights, barrier bars, and other warning equipment that is activated upon the approach of a train.

Precast foundations for such railroad crossing and traffic signals have been constructed into holes in the ground aside railroad tracks. Such precast railroad signal foundations have been made and installed as unitary structures and also as in-ground assembled modules. Poured concrete foundations have also been formed at the job site by digging a hole aside the railroad crossing, erecting a wood molding frame to contain poured concrete about the perimeter of the hole, and then pouring concrete into the frame. These poured concrete foundations have been erected with embedded guide rods that protrude from their tops to which signal equipments is mounted and anchored in place. The modular type foundations often have multiple tiers of interlocking spiders or spider blocks mounted upon a base slab which support the crown. Guide rods extend vertically through the several members of the foundation and protrude above the crown to provide anchors for signal equipment mounted atop the crown.

Foundations of the type just described have been beset with certain problems. For example, in mounting the spiders upon the base, and upon each other, they have had to be aligned with and lowered over the guide rods. Misalignment has caused the steel rods to chafe the concrete entry of the channels with debris falling upon the member below upon which the spider will stand unless such is first swept away. As the spider is further lowered, the tops of the rods also chafe the interior concrete walls of the channels as the spiders oscillate on their chain suspension from an overhead hoist or the like. This chafing also promotes corrosion of the metal rods.

Even long after such foundations have been erected, the guide rods have become eroded by lime leached from the concrete channels, as concrete is approximately 60% lime, the deterioration of metal components can occur very quickly. Concrete foundations have also been designed with metal tubes through which the metal guide rods extends. These metal tubes however are in direct contact with the concrete. As such, the lime within the concrete quickly corrodes and deteriorates the metal tubes. As this occurs, the tolerances between the channel and the guide rods greatly increase resulting in an unstable foundation. Additionally, once the lime has corroded through the metal tubes it will be in contact with the metal guide rods, which will then cause its corrosion as well.

Spiders of the type just described have also proven to be costly and hazardous to install. Many workers have been injured in manipulating the spiders in interlocking them with individual tiers and in erecting them into multi-tiered structures. Finger losses unfortunately occur from time to time. Additionally, working under such conditions has caused the time required to erect such foundations to be excessive.

Accordingly, it is seen that a railroad crossing and traffic control signal foundation that overcomes or alleviates the just describe problems is needed. It is to the provision of such therefore that the present invention is primarily directed.

SUMMARY OF THE INVENTION

In a preferred form of the invention a railroad crossing signal foundation comprises of a concrete base, a concrete spider mounted upon the base, and a crown supported upon the spider. The spider is of unitary concrete construction having a hub portion from which legs radiate that have parallel channels therethrough lined with plastic liners. A set of metallic rods is mounted to the base that extend uprightly through the plastic lined spider channels and through the crown to the top ends of which signal equipment may be anchored upon the crown with the metallic rods being insulated by the plastic liners from corrosion by lime leached from the spider concrete.

In another preferred form of the invention, a spider for a railroad crossing signal foundation comprises a concrete block having a plurality of tubular channels extending in parallel relation therethrough with each channel having a main cylindrical section, a truncated conical entry section, and a plastic liner positioned within the main section. The conical entry section has minimum and maximum diameters that straddle the diameter of the main cylindrical section. The plastic liner has an inside diameter substantially equal to or greater than the minimum diameter of the entry section. So constructed, upon mounting the spider over a set of upright guide rods during in situ assembly of a foundation, the guide rods are guided into the main channel section by the channel entry sections without dislodging the channel liners.

In yet another preferred form of the invention, a method of producing a concrete member of a railroad signal foundation comprises the steps of providing a mold having a floor, sides, and upright poles. Plastic liners are mounted about the upright poles. Concrete is then poured into the mold about the plastic liners and the concrete is allowed to set. Once the concrete has set, the formed member is removed from the mold. The formed member is then transported to an erection site where it is lowered onto a base having a plurality of guide rods which are passed through the plastic liners.

BRIEF DESCRIPTION OF THE DRAWINGS

FIG. 4A is a perspective view of a small spider with a single eyebolt while

DETAILED DESCRIPTION

Figure 1:
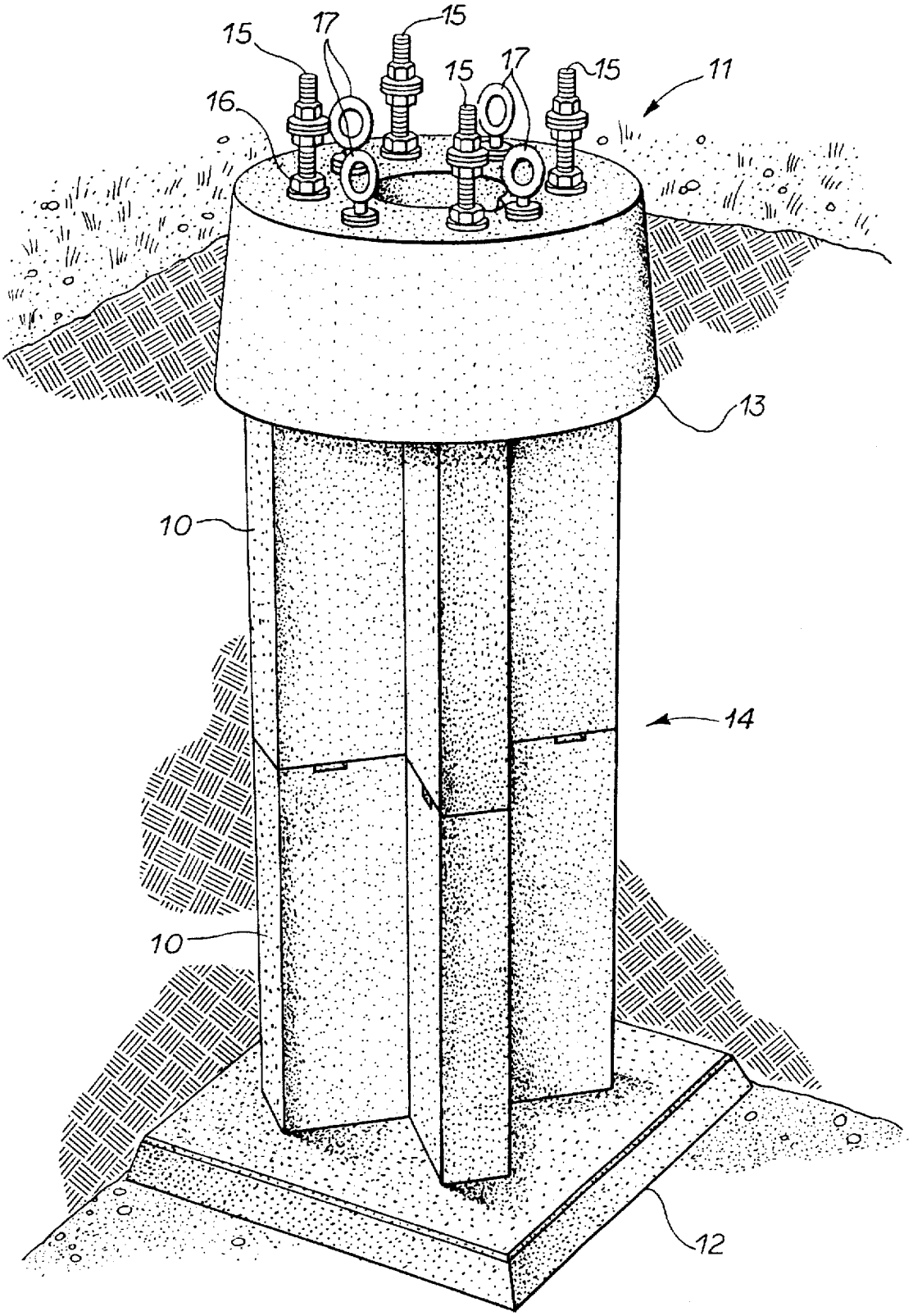
FIG. 1 is a perspective view of a railroad crossing signal foundation shown assembled in a hole in the ground that embodies principles of the present invention.

With reference to FIG. 1, a railroad crossing signal foundation 11 is shown comprised of two spiders 10 in the shapes of crosses having a central portion or hub from which four legs radiate at right angles with respect to each other. The spiders are mounted atop a base 12 supporting a crown 13 with the two spiders providing a pillar 14. Threaded top portions of four upright guide rods 15 are shown extending above the crown to which nuts 16 are mounted in holding the crown 13, the pillar 14 and the base 12 together as an integral foundation. Unshown railroad crossing and traffic signals may be mounted atop the crown anchored to the exposed ends of the guide rods. Also shown here are the four eyebolts 17 used for lifting and moving the structure by hook and crane.

Figure 2A:
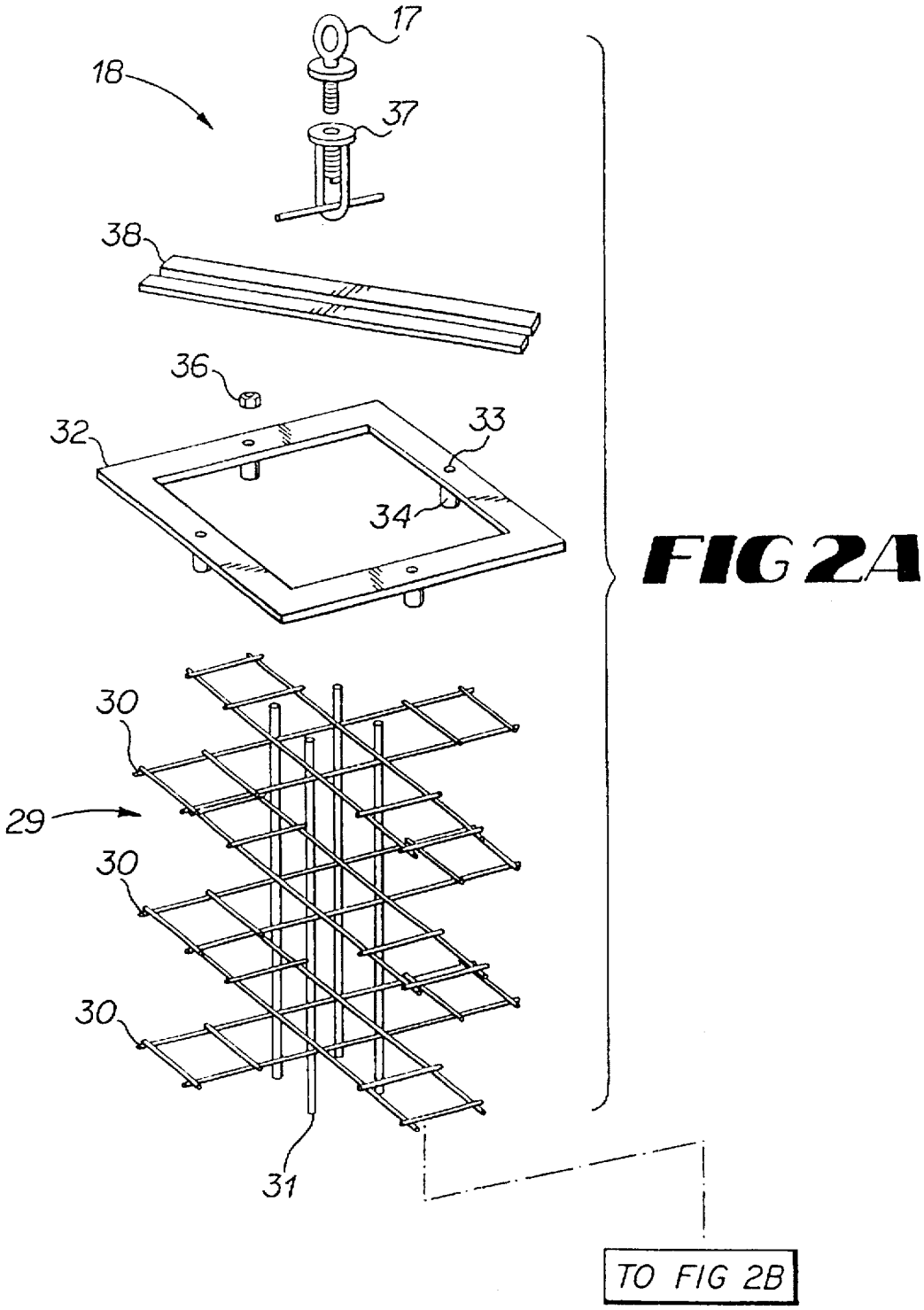
FIG. 2A is an exploded view of an upper brace to be mounted atop a mold, a wire mesh to be mounted within the mold, and an eyebolt and insert to be mounted in the concrete.
Figure 2B:
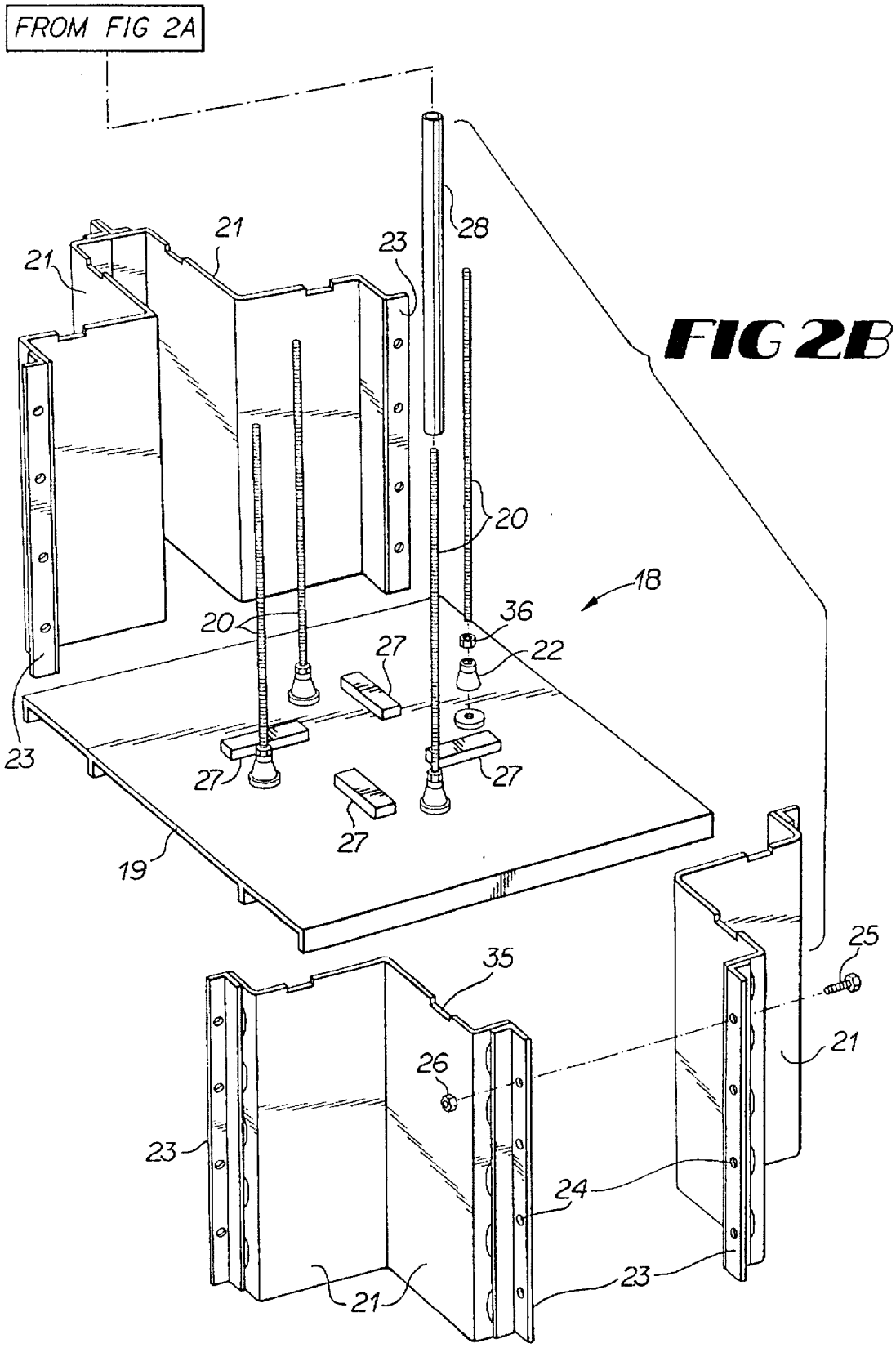
FIG. 2B is an exploded view of the mold.
Figure 3:
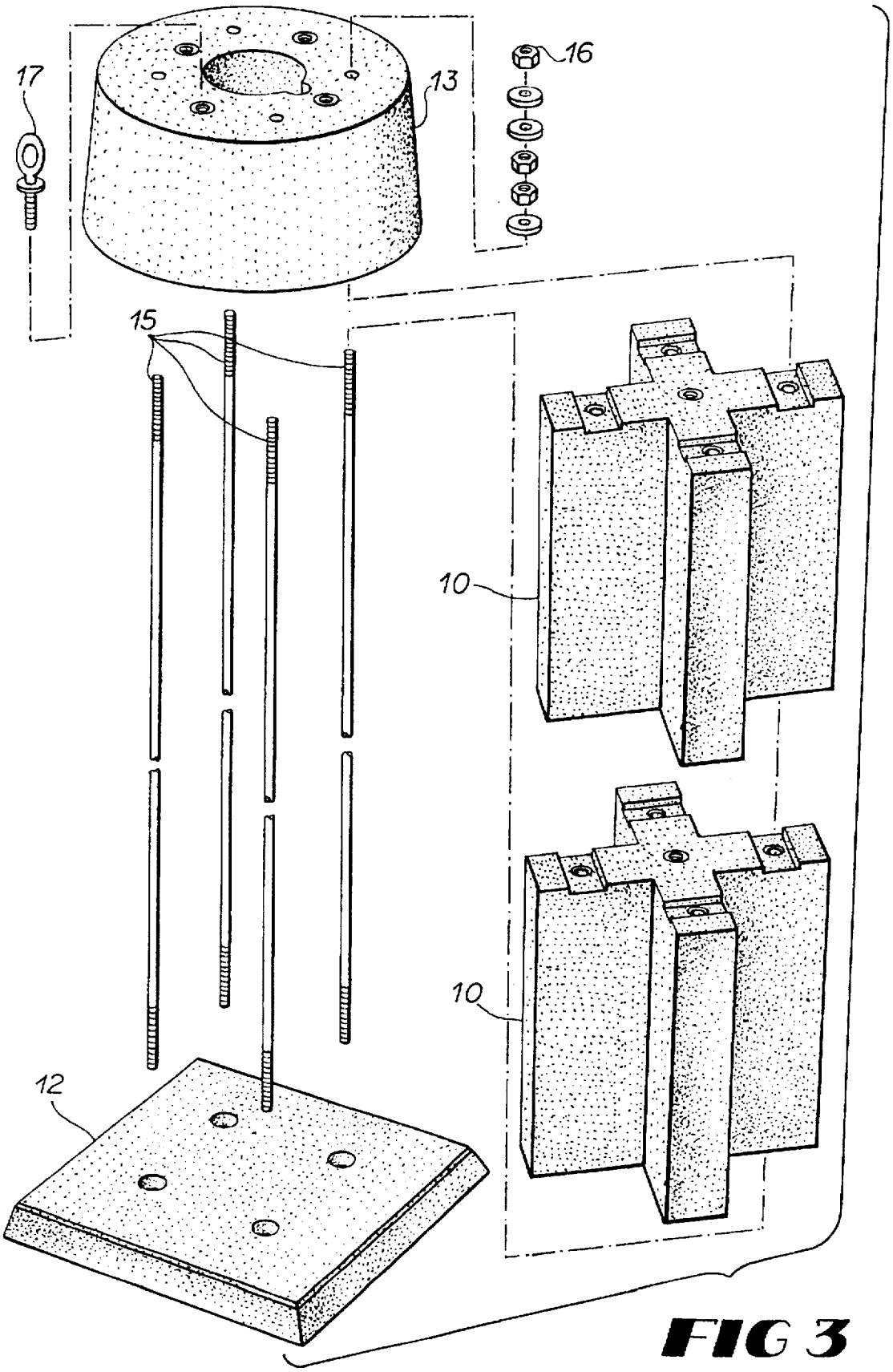
FIG. 3 is an exploded view of the railroad crossing signal foundation shown assembled in FIG. 1.

With reference next to FIG. 2B, there is shown a mold 18 for forming a spider. The mold is comprised of a mold floor 19, four threaded rods 20 mounted uprightly on the floor, and sides 21, all of which are made of metal. The threaded rods 20 are received through unshown holes in the floor to which unshown nuts are secured against the underside of the mold floor. On the top of the mold floor a threaded centering pin 22 is mounted about each rod.

The mold sides 21 are made of custom formed steel sheets. Each sheet has several folds for forming the sides of the spider and a flange 23 welded to the ends. Each flanges is made of angle iron and has several holes 24 for receiving bolts 25. The mold sides are fastened together by aligning the flanges holes of two adjacent sides together, placing bolts through the holes, and screwing nuts 26 onto the bolts. Steel blocks 27 are welded to the mold floor 19 for inhibiting rotation of the mold sides 21 in relation to the mold floor. Plastic liners 28 are located on the threaded rods 20 snugged upon the lower centering pins 22.

A welded steel mesh cage 29 is shown in FIG. 2A. The cage is preferable made of steel mesh layers 30 welded to upright rods of #3 rebar 31. The cage fits about the plastic liners 28 and is surrounded by the mold sides 21. A rectangular frame 32 has holes 33 for receiving the threaded rods 20. Upper centering pins 34 having holes for receiving the threaded rods 20 are welded to the rectangular frame with the holes of the pins 34 and frame aligned. The upper centering pins are slightly narrower than the lower centering pins 22. Both the upper and lower centering pins are preferable made of stainless steel, but the hole of the upper centering pin, unlike the lower centering pin, is not threaded. The rectangular frame is fitted over the threaded rods with the upper centering pins placed in the tops of the plastic liners for centering the plastic liners about the threaded rods and with the frame being placed into detents 35 in the mold sides. Nuts 36 are placed in the threaded rods and screwed snugly against the frame 32 to hold the mold together. The positioning of the frame within the detents of the mold sides inhibits rotation of the mold sides in relation to the mold floor and the frame.

To form the spider of the present invention, the mold 18 is first secured just as described with the plastic liners 28 mounted upon the centering pins 22 and within the cage 29 about the plastic liners and surrounded by the mold sides. Concrete is then poured into the mold about the plastic liners 28 and then the cage 29 which serves to reinforce the concrete. The top of the concrete is smoothed with a trowel at a level approximately equal to the level of the tops of the mold sides. As the concrete is allowed to set, a conventional coil loop insert 37 and an eyebolt 17, as best shown in FIG. 2A, are placed into the smoothed top of the concrete. The coil loop and the eyebolt are held in place by pieces of wood 38 resting on the top of the frame 32.

Once the concrete has set, the nuts 26 and bolts 25 of the mold are loosened to release the mold from the now formed spider. A crane or hoist hook is attached to the eyebolt 17, shown in FIG. 4A, for lifting the spider out of the mold. The crane is then maneuvered to lift the spider out of the mold. The mold may be loosened either prior to or during the lifting stage. If upon lifting the spider, the weight of the mold is not sufficient to loosen it from the spider, a hammer may be used to jar the mold from the spider.

Figure 4A:
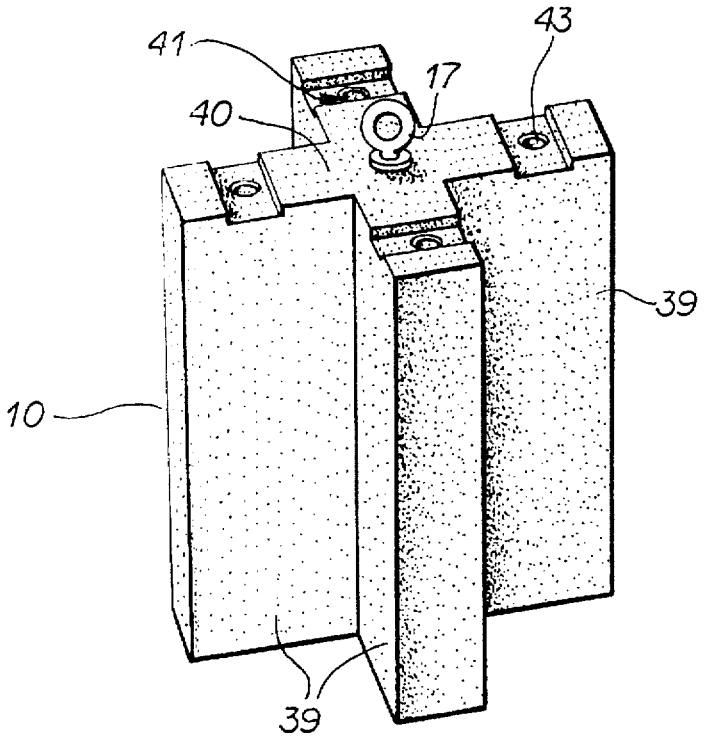
Figure 4B:
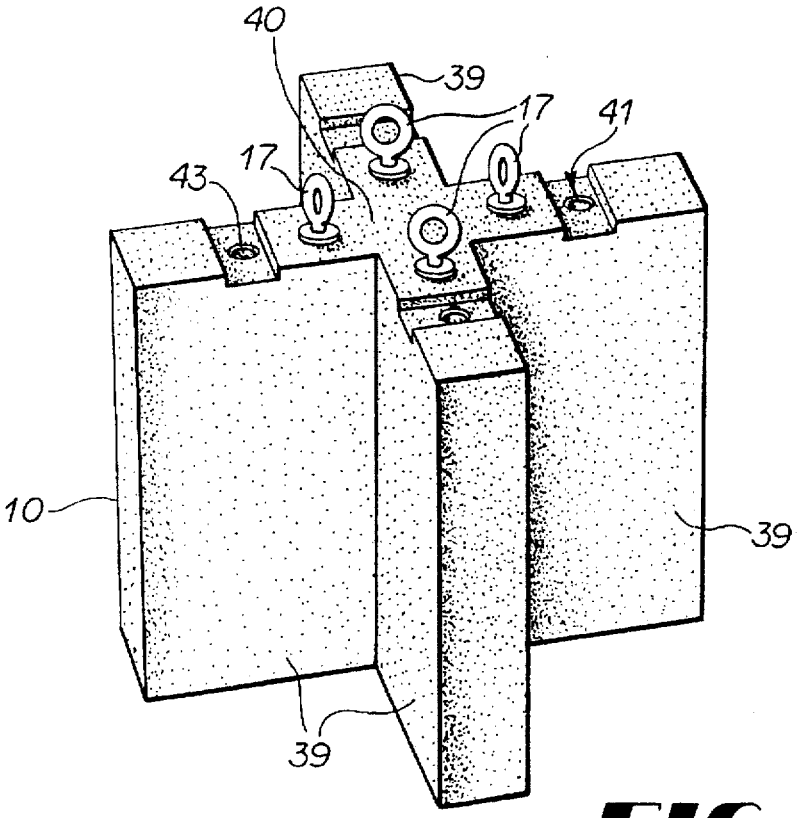
FIG. 4B is a perspective view of a large spider with four eyebolts.
Figure 5:
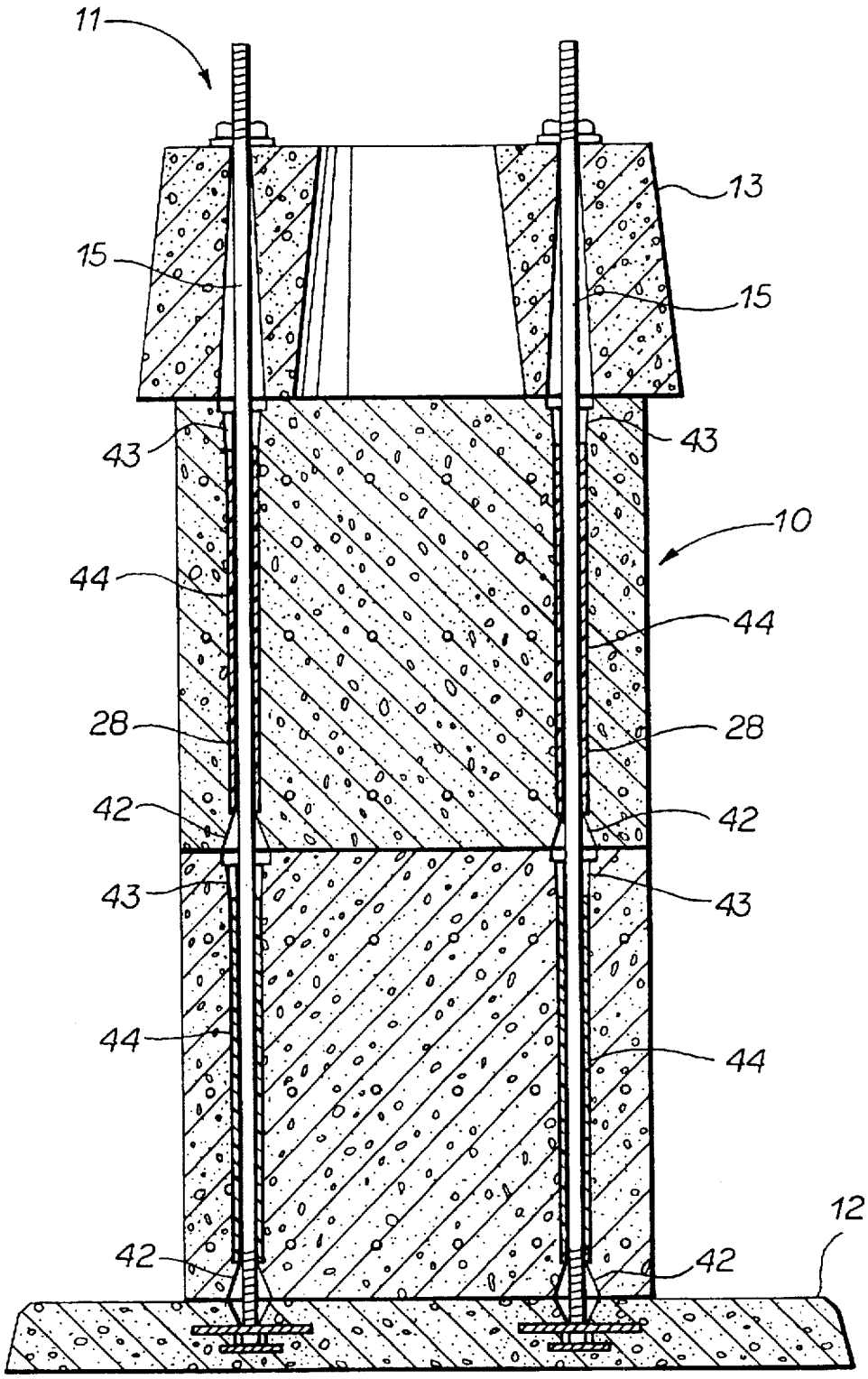
FIG. 5 is a cross-section view of the railroad crossing signal foundation of FIG. 1.
Figure 6A:
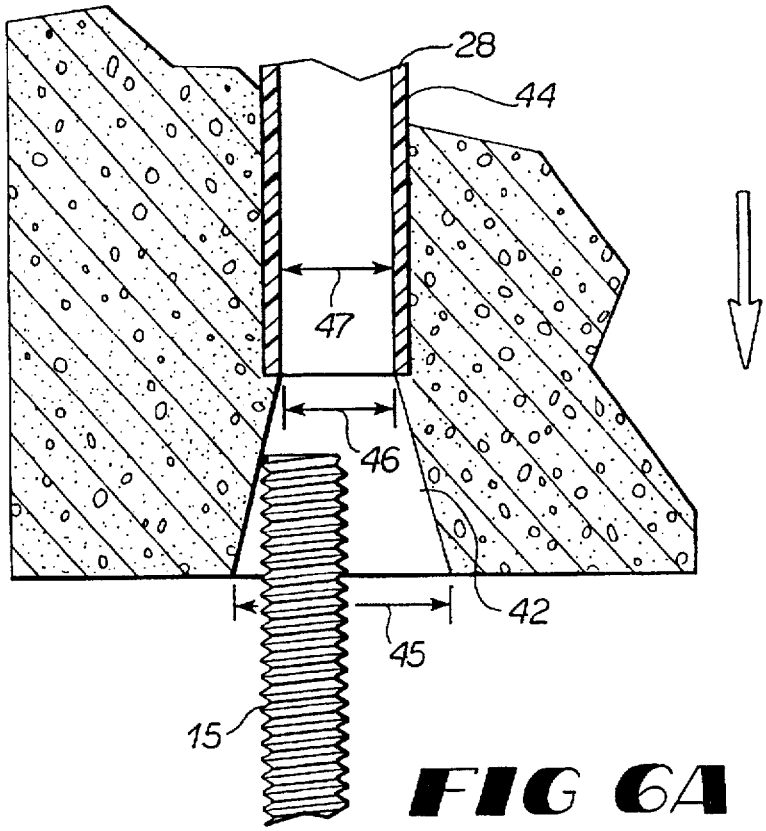
FIGS. 6A and 6B are sequential cross-section views of a foundation spider showing the spider being mounted upon a guide rod.
Figure 6B:
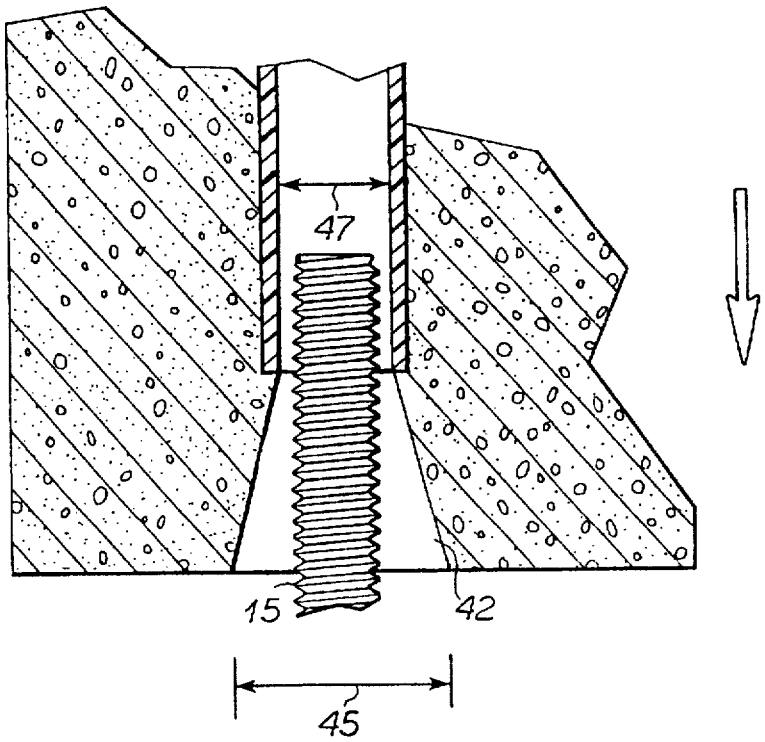

As best shown in FIGS. 4A and 4B, the spiders have four legs 39 which extend radially from a central or hub portion 40. Tubular channels 41, as shown in FIGS. 4A, 4B and 5, extend in parallel relation through the spider legs 39. The tubular channels have truncated conical entry sections 42 at their bottoms and modified truncated conical exit sections 43 at the top of each channel. Each channel has a main cylindrical section 44 that extends between its entry and exit sections. For clarity the steel mesh cage 29 is not shown in FIG. 5. As shown in FIGS. 6A and 6B, each entry section has a maximum diameter 45 which is greater than the diameter of the main cylindrical section and minimum diameter 46 which is substantially the same as the inner diameter 47 of the plastic liner.

In mounting the spider upon the upright guide rods 15 upon the base slab 12, the spider is lowered onto the guide rods by crane and hook attached to the eyebolt 17. As shown in FIG. 6A, as the spider is lowered the guide rods 15 may encounter a truncated conical entry section 42 of a channel and thereby be guided into a plastic liner 28 located within the main channel section 44. In this manner the spiders are self-aligned upon the guide rods and without significant risk of a guide rod contacting an end of the plastic liner and dislodging it from a channel.

Smaller spiders may be, for example, 24 inches in height and 20 inches in width. Larger ones may, for example, be of the same height but 39 inches in width. In the smaller sized spider, the plastic liners have a diameter of one inch and a single eyebolt is used for lifting the spider as can be seen in FIG. 4A. In the larger sized spider, the plastic liners have a diameter of 1½ inches and four eyebolts are used for lifting the spider as can be seen in FIG. 4B. The plastic liners themselves are preferable made of polyvinyl chloride, however, it should be understood that most plastics may be used. However, it is critical that these liners be made of a plastic material rather than a metallic material, as metal will quickly erode or corrode in contact with the lime within concrete. Another distinct advantage associated with plastic liners over the metal tubes of the prior art is the fact that rust and other types of corrosion from the liners will not settle upon the metal nuts or inserts to which the guide rods are threadably mounted. In the past, this type of corrosion has prevented the guide rod from being threadably removed once it is damaged, which often occurs if the signal is struck by a large force. Without the ability to remove the guide rods the entire foundation may have to be unearthed to repair the damage.

As best shown in FIGS. 6A and 6B, the liners are embedded above the bottom surface of the spiders and crown with the concrete extending to the internal diameter of the liner, i.e. overlaying or covering the end of the liners. As such, the concrete protects the end of the liner from contact by the guide rod during mounting. This will aid in preventing the liner from being dislodged and preventing the fracturing of the liner should the guide rod contact the end of the liner during alignment and lowering. This prevention of liner fracture ensures that fractured pieces of the liner will not become lodged between the guide rod and the liner which could cause the binding of the guide rod and prevention of its passage through the liner.

Figure 7:
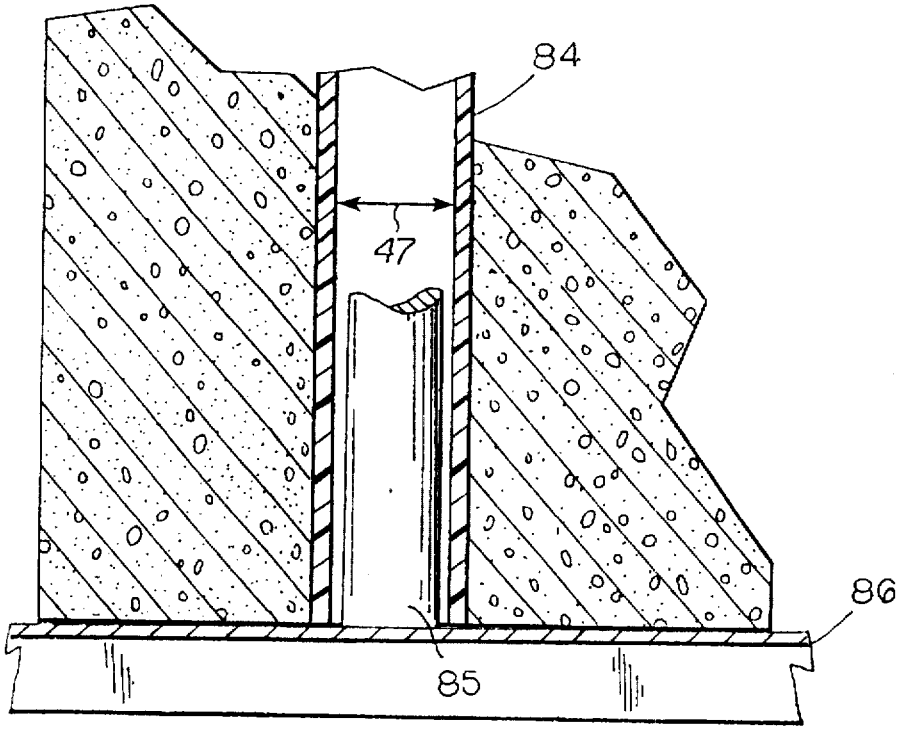
FIG. 7 is a cross-sectional view of a portion of a foundation spider being constructed in an alternative form of the invention.
Figure 8:
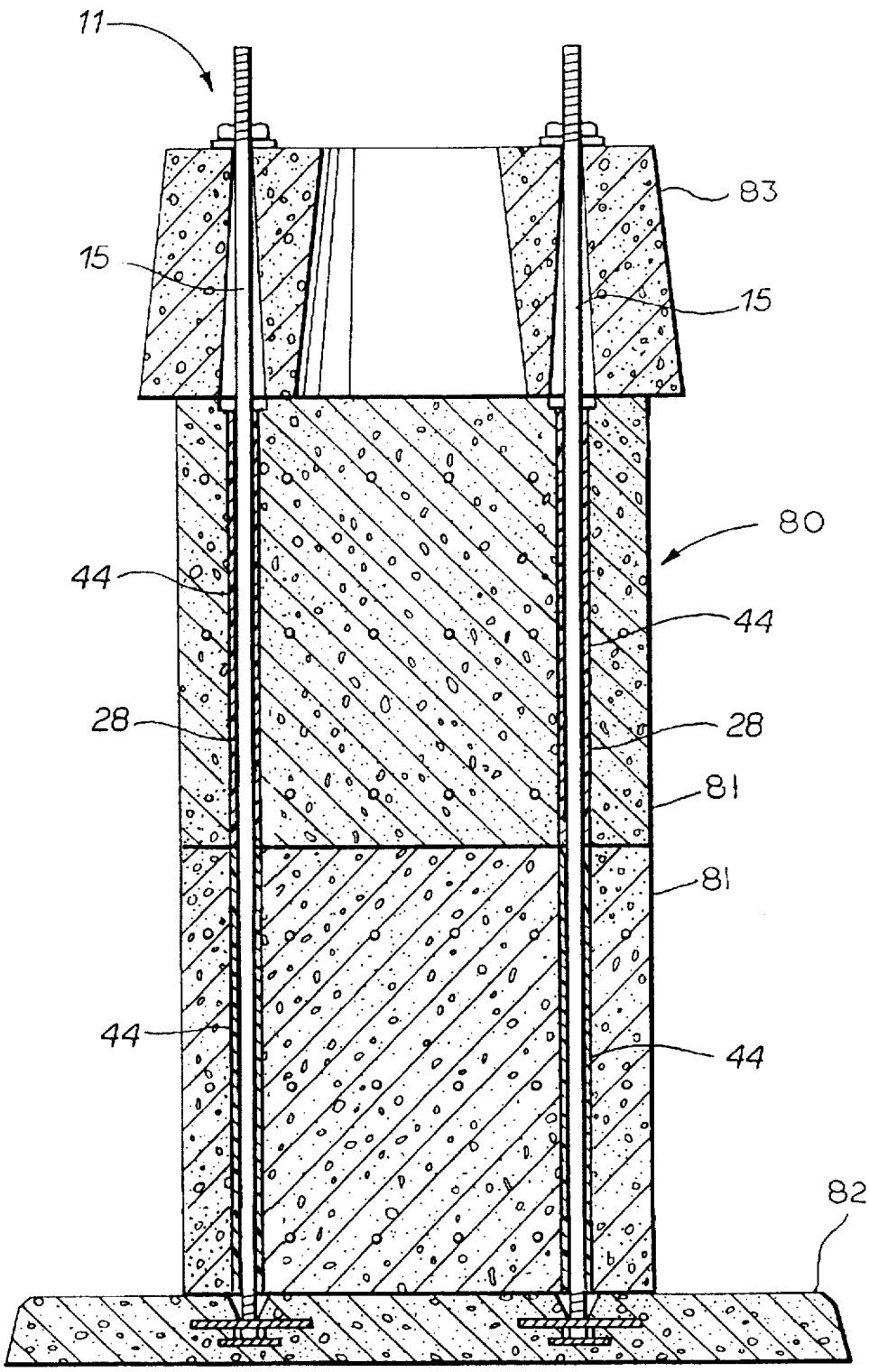
FIG. 8 is a cross-sectional view of a railroad crossing signal foundation with a spider constructed in accordance with the embodiment of FIG. 7.

In FIG. 8 a railroad crossing signal foundation 80 is shown embodying principles of the invention in an alternative, preferred form. The foundation here comprises two spiders 81 mounted atop a base 82 supporting a crown 83. The base, spiders and crown are of the same construction as previously described except for the tubular channels. As shown in FIG. 7, the channels are formed by placing 1¼ inch inside diameter polyvinyl chloride tube liners 84 uprightly and loosely about mold rods 85, having a 1 inch outside diameter, extending upwardly from the mold floor 86. These rods extend to the top of each spider. Thus, here the spiders are not formed with the conical portions 42 and 43 as those of the previously described embodiment. They do however still have the annular, enlarged countersinks at the upper end of the channels. The plastic liners extend approximately ⅛ inch above the upper surface of the spider. Later, during assembly, these protruding ends are pressed down into the countersinks about the guide rods that extend from the foundation base through the crown. The ¼ inch clearance between the guide rods and the plastic liners facilitate placement of the liners about the upright guide rods. This same clearance serves later to facilitate assembly of the spiders onto each other and the base with the guide rods extending through the spider liners.

Since each spider here is of unitary construction with an eyebolt for mechanically lifting and manipulating it, it overcomes the problem of raising, manipulating, and interlocking by hand associated with prior art spiders of interlocking construction. Since the entry sections of the new spider are shaped and aligned to readily receive the upright guide rods when mechanically lowered onto the guide rods, the new spider overcomes the problems of manually aligning spiders for mounting onto guide rods. The plastic liners positioned within its channels separate the metallic guide rods from the concrete of the spider to overcome the problem of corrosion due to their exposure to lime leaching from the concrete. At the same time the dimensional channel entries do not subject the liners to be dislodged by the guide rods as the rods are guided into the channels.

It is thus seen that a new railroad signal foundation and spider, and a new method of producing such, is now provide that overcomes problems long associated with those of the prior art. It should be understood however that many modifications, additions, and deletions may be made thereto without departure from the spirit and scope of the invention as set forth in the following claims.

I claim:

1. A spider for a railroad crossing signal foundation comprising a concrete block having a means for removably mounting an eyebolt thereto and a plurality of tubular channels extending in parallel relation through said concrete block with each of said channels including a main cylindrical section and a truncated conical entry section with said entry section having minimum and maximum diameters that straddle the diameter of said cylindrical section, and a plastic liner positioned within each of said channel cylindrical sections having an inside diameter substantially equal to or greater than said channel entry section minimum diameter, whereby the spider can be manipulated and suspended by the removable eyebolt and mounted upon a plurality of upright guide rods during in situ assembly of a foundation such that the guide rods are guided into the main channel section by the channel entry sections without dislodging the channel liners.

2. The spider of claim 1 wherein said concrete block has a hub portion from which a plurality of legs radially extend and said tubular channels extend through said legs.

3. A railroad crossing signal foundation comprising a concrete base, at least one concrete spider mounted upon said base, and a crown supported above said spider, and wherein said spider is of unitary concrete construction having a hub portion from which more than two legs radiate that have parallel channels therethrough lined with plastic liners, said spider hub portion having means for removably mounting at least one eyebolt thereto for use in lifting and erecting said spider as a unitary component of the foundation, and a plurality of metallic rods mounted to said base that extend uprightly through said plastic lined spider channels and through said crown, wherein signal equipment is capable of being anchored to the crown at the top ends of the metallic rods with the metallic rods insulated by the plastic liner from corrosion by lime leached from the spider concrete.

4. The railroad signal foundation of claim 3 wherein each of said spider channels has a bottom entry that flares outwardly from adjacent the bottom end of a channel plastic liner to serve as a guide in mounting the spider upon said guide rods.

5. A railroad crossing signal foundation comprising a concrete base, at least one concrete spider mounted upon said base, and a crown supported above said spider, and wherein said spider is of unitary concrete construction having a hub portion from which more than two legs radiate that have parallel channels therethrough at least partially lined with plastic liners, and a plurality of metallic rods mounted to said base that extend uprightly through said plastic lined spider channels and through said crown wherein signal equipment is capable of being anchored to the crown at the top ends of the metallic rods with the metallic rods insulated by the plastic liner from corrosion by lime leached from the spider concrete.

6. The railroad signal foundation of claim 5 wherein each said spider has a bottom surface and each said plastic liner has a lower end embedded within the spider distally from said spider bottom surface.

7. The railroad signal foundation of claim 6 wherein each of said spider channels has a bottom entry that flares outwardly from adjacent said lower end of said channel plastic liner to serve as a guide in mounting the spider upon said guide rods.

* * * * *